United States Patent [19]

Bahel et al.

[11] 4,194,368

[45] Mar. 25, 1980

[54] COMBINATION SPLIT SYSTEM AIR CONDITIONER AND COMPRESSION CYCLE DOMESTIC HOT WATER HEATING APPARATUS

[75] Inventors: Vijay O. Bahel, Schaumburg; Richard R. Kuehner, Mt. Prospect; Richard H. Rosenberg, Wilmette, all of Ill.

[73] Assignee: Borg-Warner Corporation, Chicago, Ill.

[21] Appl. No.: 729,503

[22] Filed: Oct. 4, 1976

[51] Int. Cl.[2] ..... F25B 27/02; F25B 13/00; F25B 7/00

[52] U.S. Cl. ..... 62/238; 62/324; 62/335; 62/510

[58] Field of Search ..... 62/238, 324, 510, 155, 62/335, 2

[56] References Cited

U.S. PATENT DOCUMENTS

| | | | |
|---|---|---|---|
| 2,125,842 | 8/1938 | Eggleston | 62/238 |
| 2,586,454 | 2/1952 | Brandin | 62/335 |
| 2,680,956 | 6/1954 | Haas | 62/335 |
| 2,690,649 | 10/1954 | Borgerd | 62/238 |
| 2,717,765 | 9/1955 | Lawler, Jr. | 62/335 |
| 2,796,743 | 6/1957 | McFarlan | 62/335 |
| 3,301,002 | 1/1967 | McGrath | 62/238 |
| 3,852,974 | 12/1974 | Brown | 62/510 |

*Primary Examiner*—Lloyd L. King
*Attorney, Agent, or Firm*—Thomas B. Hunter

[57] ABSTRACT

A conventional split system air conditioner is combined with a compression cycle or heat pump system for supplying heat to a domestic water heater. The units are combined in such a way that significant energy savings can be achieved by circulating air in series through the outdoor evaporator coil of the hot water heating system and then through the condensing coil of the heat pump, or vice-versa. This has the advantage of increasing the coefficient of performance for both systems. The direction of air flow will be selected on the basis of achieving the greatest improvement in energy savings and can be provided with automatic reversal of the air flow direction, depending on the ambient air quality and/or the operating state of either unit.

5 Claims, 1 Drawing Figure

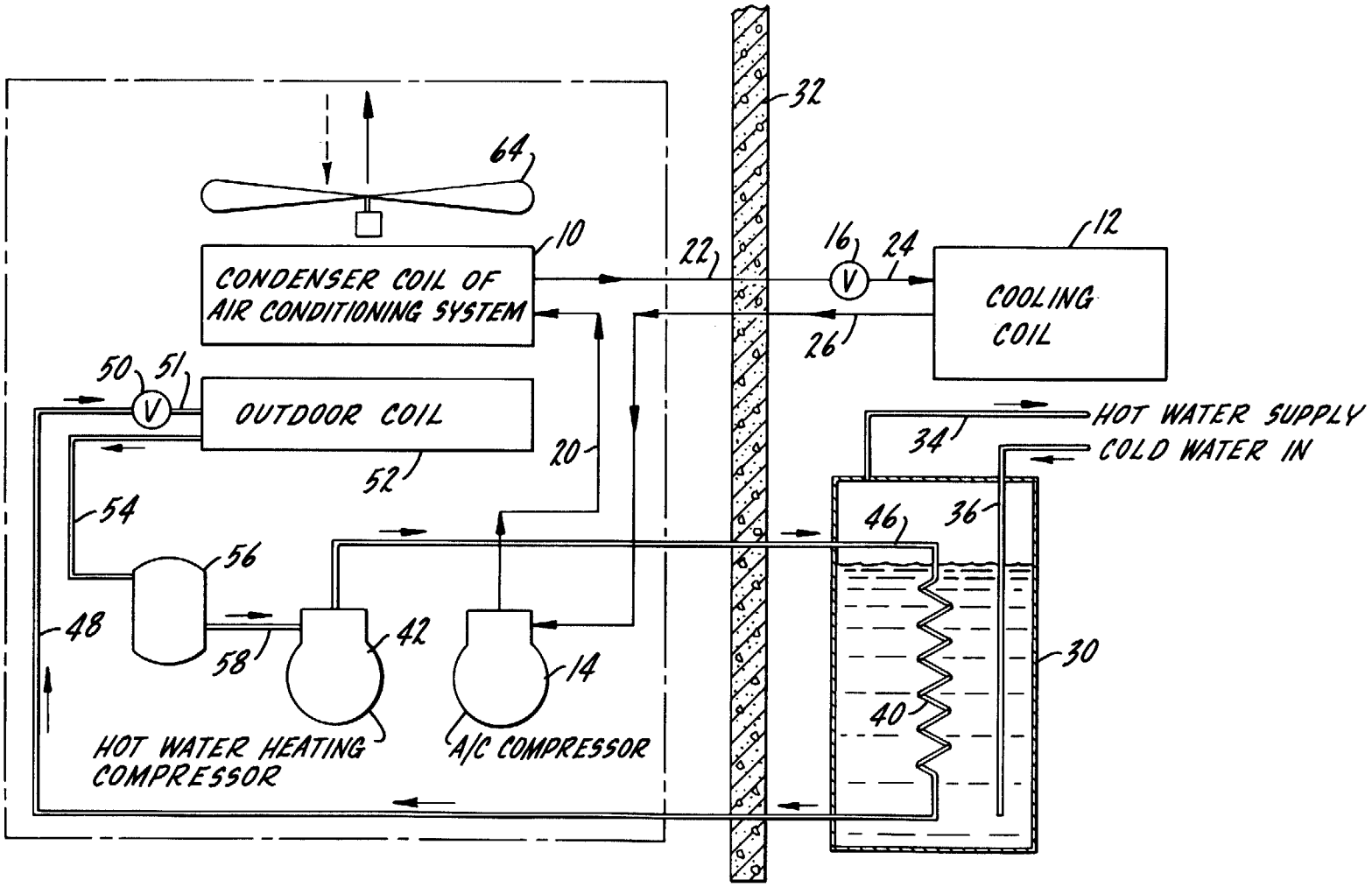
COOLING COIL
HOT WATER SUPPLY
COLD WATER IN
CONDENSER COIL OF AIR CONDITIONING SYSTEM
OUTDOOR COIL
A/C COMPRESSOR
HOT WATER HEATING COMPRESSOR
12
30
36
34
46
40
24
16
26
32
22
10
20
14
64
42
52
56
58
51
50
54
48

COMBINATION SPLIT SYSTEM AIR CONDITIONER AND COMPRESSION CYCLE DOMESTIC HOT WATER HEATING APPARATUS

BACKGROUND OF THE INVENTION

Field of the Invention

Combined air conditioner and domestic hot water heater using compression cycle system.

DESCRIPTION OF THE DRAWING

The single FIGURE is a schematic diagram illustrating the principles of the present invention.

DETAILED DESCRIPTION OF THE INVENTION

Referring to the FIGURE, the present invention comprises a combination system using, on the one hand, a split system air conditioner and, on the other hand, a domestic hot water heater using a compression cycle system for supplying thermal energy to the water storage tank. As shown in the FIGURE, the split system air conditioner comprises a condenser 10, an evaporator 12, a compressor 14, and an expansion device 16. Hot gas line 20 connects the compressor with the condenser; hot liquid line 22 connects the condenser with expansion device 16; warm liquid line 24 connects expansion device 16 with the evaporator 12; and suction line 26 connects the evaporator with the suction side of compressor 14.

In the hot water heating system, tank 30, which is usually located indoors as depicted schematically to the right hand side of building wall 32, includes hot water supply line 34 leading from the tank and cold water inlet 36 leading to the tank from the water service lines. The heat exchanger coil 40 is in heat exchange relation to the water in the tank and this coil constitutes the condensing unit for the compression cycle refrigeration system. The latter includes a compressor 42, hot gas line 46, warm liquid line 48, expansion device 50, outdoor coil 52, a line 54 leading to the accumulator 56, and suction line 58 connecting the accumulator with the suction side of compressor 42.

In the operation of the domestic hot water heating system, hot refrigerant vapor, at a temperature of about 220°-230° F., is delivered through line 46 to the coil 40. This high pressure vapor releases great quantities of heat when condensed and is sufficient to maintain the desired thermal input to the water tank 30. The condensed liquid then flows to expansion device 50, through line 48, and then through line 51 to the outdoor coil where it is evaporated. The vapor then flows through the accumulator 56 and suction line 58 to the inlet side of compressor 42.

The condensing coil 10 of the air conditioning system and the outdoor evaporating coil 52 of the domestic hot water system are in juxtaposed relation so that the entering air for the air conditioning condenser coil 10 comes off the outdoor coil 52 in the domestic hot water system, as directed by fan 64. This cooler air will reduce the load on the condenser 10 and greatly improve the performance of the air conditioning system.

When the ambient temperature is fairly low; but cooling is still required because of conditions such as the sun load etc., the flow of air can be reversed for satisfactory performance of the water heating system. In this case the air flows downwardly off the condensing coil 10 onto the evaporator 52 and can be employed to heat the outdoor coil, increasing the evaporation of refrigerant in the outdoor coil and thereby raising the c.o.p. of the domestic hot water heating system.

While this invention has been described in connection with a certain specific embodiment thereof, it is to be understood that this is by way of illustration and not by way of limitation; and the scope of the appended claims should be construed as broadly as the prior art will permit.

What is claimed is:

1. The combination comprising: a split system air conditioning apparatus including a refrigerant compressor, a condenser, an expansion device and an evaporator all connected in closed circuit, series flow relation; a compression cycle system supplying thermal energy to a hot water reservoir, said system including a refrigerant compressor, a condenser, an expansion device and an evaporator all connected in closed circuit, series flow relation, said split system air conditioner condenser and said compression cycle evaporator being in mutual heat exchange relation, including means for circulating air in series, first over said compression cycle evaporator and then over said air conditioner condenser such that the air cooled by contact with said evaporator reduces the operating temperature of said condenser.

2. The combination comprising: a split system air conditioning apparatus including a refrigerant compressor, a condenser, an expansion device and an evaporator all connected in closed circuit, series flow relation; a compression cycle system supplying thermal energy to a hot water reservoir, said system including a refrigerant compressor, a condenser, an expansion device and an evaporator all connected in closed circuit, series flow relation, said split system air conditioner condenser and said compression cycle evaporator being in mutual heat exchange relation, including means for circulating air in series first over said air conditioner condenser and then over said compression cycle system evaporator such that the air warmed by contact with said condenser augments evaporation in said compression cycle system evaporator.

3. The combination comprising: a domestic hot water reservoir including cold water inlet and hot water outlet means; a heat exchanger associated with said reservoir, a refrigerant compressor including a hot gas line interconnected with said heat exchanger; an outdoor evaporator coil; an expansion device connected between said heat exchanger and said outdoor evaporator; and means connecting said outdoor evaporator with the suction side of said compressor; a split system air conditioner including a refrigerant compressor, a condenser, an expansion device and an evaporator, all connected in closed circuit, series flow relation, said air conditioner condenser and said outdoor evaporator coil being located in juxtaposed relation with respect to each other; and air circulating means adapted to direct air in either direction, in series between said outdoor evaporator coil and said air conditioner condenser.

4. The combination as defined in claim 3 wherein said air circulating means directs air in series through said outdoor evaporator coil and then through said condenser.

5. The combination as defined in claim 3 wherein said air circulating means is adapted to direct air in series through said air conditioner coil and then through said outdoor evaporator coil.

* * * * *